United States Patent [19]

Heubner et al.

[11] 4,264,441

[45] Apr. 28, 1981

[54] AUTOMATIC CONTROL FOR ELECTRO-PNEUMATIC WET SETTLING

[75] Inventors: Friedhelm Heubner, Bochum-Riemke; Werner Hasse, Bochum-Stiepel; Karl-Heinz Weiffen, Bochum-Riemke, all of Fed. Rep. of Germany

[73] Assignee: Klöckner-Humboldt-Deutz AG, Fed. Rep. of Germany

[21] Appl. No.: 35,702

[22] Filed: May 3, 1979

[30] Foreign Application Priority Data

May 26, 1978 [DE] Fed. Rep. of Germany ..... 2823148

[51] Int. Cl.[3] ..... B03B 5/24

[52] U.S. Cl. ..... 209/500; 364/502

[58] Field of Search ..... 209/455, 457, 500–502, 209/1; 210/97, 104, 143; 364/502, 420

[56] References Cited

U.S. PATENT DOCUMENTS 4,019,981 4/1977 Stern et al. ..... 209/500 X

FOREIGN PATENT DOCUMENTS 2411386 9/1975 Fed. Rep. of Germany .

*Primary Examiner*—Ralph J. Hill

*Attorney, Agent, or Firm*—Hill, Van Santen, Steadman, Chiara & Simpson

[57] ABSTRACT

An automatic control for an electropneumatic wet settling machine, for the separation of mineral mixtures, in particular coal, through the pulsation of the separating liquid, provides that the separating liquid is energized and controlled by means of compressed air in pulsing chambers, and that measuring devices for measuring the movement of the separating liquid are provided to signal, advantageously on an analog basis, the movement of the separating liquid in order to control the introduction and exhaust of compresssed air from the pulsing chambers.

24 Claims, 1 Drawing Figure

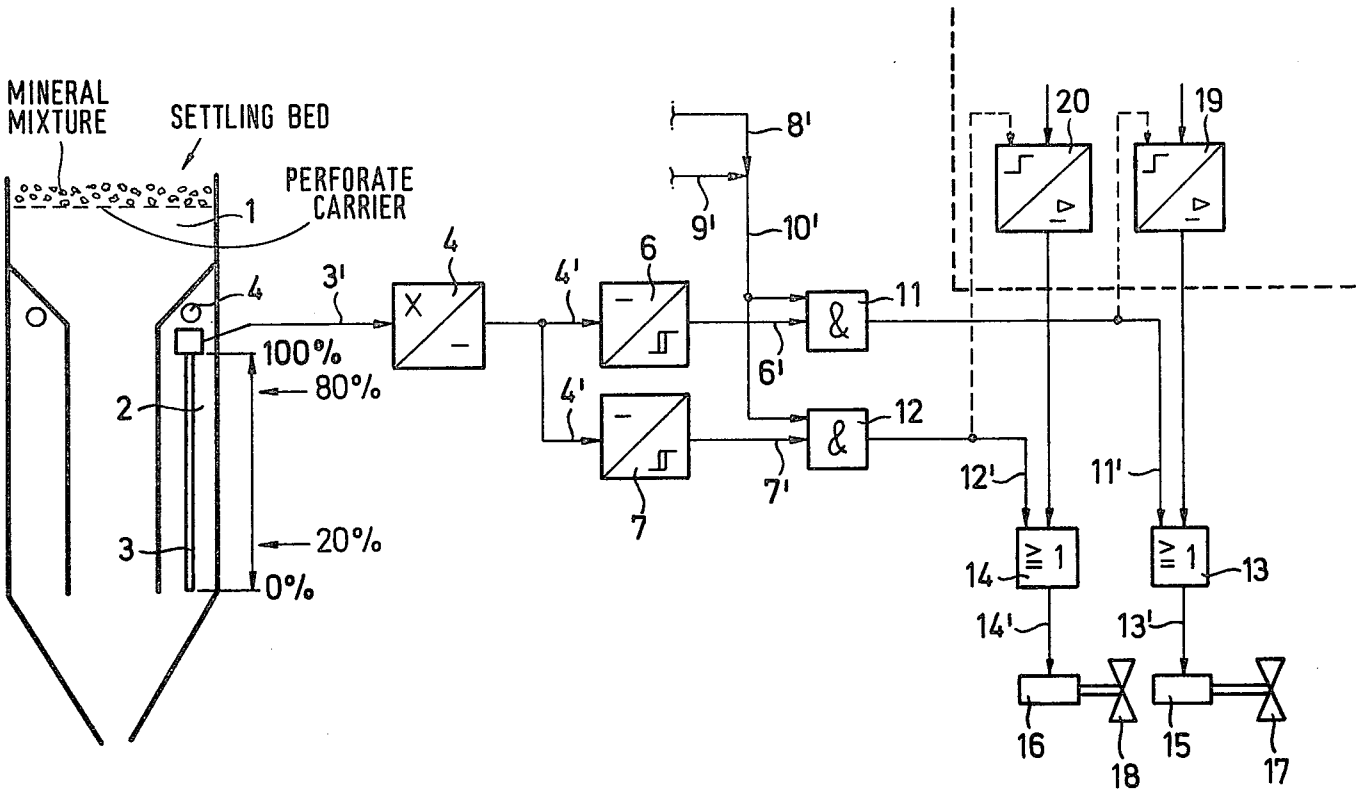
MINERAL MIXTURE
SETTLING BED
PERFORATE CARRIER
100%
80%
20%
0%
1
2
3
3'
4
4'
6
7
6'
7'
8'
9'
10'
11
12
11'
12'
13
14
13'
14'
15
16
17
18
19
20

AUTOMATIC CONTROL FOR ELECTRO-PNEUMATIC WET SETTLING

BACKGROUND OF THE INVENTION

1. Field of the Invention

The present invention relates to an automatic control for electropneumatic wet settling machines for the separation of mineral mixtures, particularly coal, through the pulsating movement of a separating liquid, in which the separating liquid is energized and controlled by means of compressed air in pulsing chambers, which have measuring devices for the movement of the separating liquid.

2. Description of the Prior Art

From the German published application No. 24 11 386.8 it is known to utilize probes for measuring the pulsating movement of a separating liquid in the energizing chambers of wet settling machines. By means of the measuring values of the probes it is possible for maintenance personnel to adapt the introduction of air, particularly the duration of the introduction of the compressed air, to the changes in the pulsating movement attained, and to control the pulsating movement. Known probes emit measuring values which indicate the position of the reversal points of the pulsating liquid in the energizing chambers. The maintenance personnel, however, may even with the greatest attention recognize and control fluctuations in the pulsation only over long periods of time. In this connection, it requires appreciable experience to recognize the necessary magnitude and position of the introduction of air from the measuring values, which are required in order to keep the machine in its normal condition of operation.

SUMMARY OF THE INVENTION

It is the object of the present invention to provide a control technique for electropneumatic wet settling machines for the separation of mineral mixtures, particularly coal, which control is fully automatic and, in the case of known settling machine controls having probes, assumes the work of the maintenance personnel. It is particularly important to be in position to process the changes occurring in the 1000th second range of the measuring values indicated by the probes, to convert the same reliably and immediately into control signals for the control of the settling machine, and to thus optimize the pulsation of the settling machine automatically.

The above object is achieved in that the measuring values of the measuring instrument, provided as signals, advantageously as analog signals, either unchanged or after a conversion, control the compressed air in the pulsing chambers. The control of the settling machine therefore takes place automatically through the utilization of the measuring values provided by the measuring device. Therefore, it is advantageously prevented that the control of the settling machine is undertaken according to subjective points of view and delayed with respect to time. In this manner, the work of a settling machine may be improved and balanced, particularly by means of the attainable optimal filling of the energizing chambers.

In a development of the invention, it is provided that the signals are fed to a boundary value switch, advantageously a limit or threshold switch having the ranges pre-, main- and alarm area, which they emit after exceeding or falling below the predetermined limit values.

By means of the utilization of limit value switches, advantageously account may be taken of high speeds at which the analog indications change. It is therefore advantageously possible, even if digitally operating settling machine controls are utilized, as they are described in the Prospectus No. 5175 4 69 of the Wedag Westfalia Dinnendahl Groeppel AG, to abandon analog/digital converters, which convert the analog signal into digital signals. Therefore, the reliability and practicality of the control is further increased. Through the utilization of limit value switches, it is possible to establish a normal area for the machine, in which no control commands are imparted. First, control commands are imparted upon the detection of pulsations which leave the normal range. Therefore, the number of the control commands decreases appreciably. At the same time, the operation may be with a system without damping. This is particularly advantageous for the direct influencing of the settling operation with greater deviation. A further improvement means the initiation of limit value switches with control areas. Therefore, an adaptation of the necessary control commands to the size of the fluctuations of the pulsation from the normal area may take place. In a further embodiment of the invention, it is provided that the limit value switch influences the inlet period of the air in the pulsing chamber. This influence is the simplest and most favorable influence. It has been found that a change in the inlet time is primarily sufficient in order to reliably control a pulsating movement.

In a further development of the invention, it is provided that the limit value switch influences the exhaust period of the air of the pulsation chambers. This possibility is, for example, selected when because of particular circumstances in the case of the machine, the control of the inlet time alone is not sufficient in order to quickly control the pulsation to the normal condition. This measure is, for example, seized when the limit value switch veers from the main limit value range into the alarm area.

In a further development of the invention, it is provided that the duration of the air inlet and/or outlet time is altered proportionally to the transmission time of the limit value switch. In this manner, advantageously a connection is provided between the size of the deviation of the limit value from the reference value and the corrective measure. Such a limit value proportional regulation is substantially more simple to carry out than a total proportional regulation. The proportional value may, in each case, be differentially adjusted according to actuation of the different control areas of the limit value switch. Therefore, a particularly advantageous rapid return of the settling machine pulsation from the abnormal operational conditions to normal operational conditions is possible.

In a further development of the invention, it is provided that the air inlet or outlet time, in each case, is increased or diminished by the release time of the limit value switch. This type of control with the release time alteration time ratio of 1:1 sets forth a particularly favorable solution, which was revealed as sufficient for the normal operation.

In another embodiment of the invention, it is provided that the measuring value, as signals after conversion, bring about the adjustment of a digital control device, which regulates the duration and position of the air introduction into the pulsing chambers. Through this construction, after an analog/digital conversion, a particularly simple evaluation of the measuring signals is possible in the known pulse control, as it is described in the previously mentioned prospectus of the Wedag Westfalia Dinnendahl Groeppel AG.

In a further embodiment of the invention, it is provided that as a measuring device in the pulsing chambers, probes, particularly rod-shaped, capactively operating probes, extending over the entire height of the pulsating chambers, are utilized, of which at least one is located in each pulsing chamber. This embodiment is particularly advantageous, as with this construction, measuring instruments already known and approved for settling machines may be used. As probes, one may utilize probes of the type FMC 280 of the firm Endress & Hauser, Loerrach. However, other probes may be used, for example, inductively operating probes. The number of the probes per pulsating chamber is dependent on the settling bed width. With small pulsing chambers, a probe is sufficient, while with large pulsing chambers several probes distributed over the length of the pulsing chamber may be used.

BRIEF DESCRIPTION OF THE DRAWING

Other objects, features and advantages of the invention, its organization, construction and operation will be best understood from the following detailed description, taken in conjunction with the accompanying drawing, on which there is a single FIGURE which is a diagrammatic and schematic representation of a settling machine and a control constructed in accordance with the present invention.

DESCRIPTION OF THE PREFERRED EMBODIMENTS

In the diagram illustrated on the drawing, a cross-sectional view through a settling bed portion of a settling machine has been illustrated. The settling machine may be a pulsed settling machine of the type described, for example, in the "Mining Congress Journal" of May, 1974, pp. 43–49 of the American Mining Congress, Washington, D.C., under the title "Batac Jig".

In the settling bed section 1 there is arranged, in a pulsing chamber 2, a measuring probe 3, which is advantageously a capacitively operating probe. In the upper portion of the pulsing chamber 2, also designated as an energizing chamber, is an air inlet/outlet 4, with which, in each case, is correlated an air inlet valve and an air outlet valve, not shown at the settling machine.

The control of the settling machine, in the simplest boundary value embodiment, is as follows.

The probe 3 emits a signal 3' to a transmitter 4, which may be an amplifier and which emits the signal, converted as a starting signal 4', to a limit value switch 6 and a limit value switch 7. In this connection, the one limit value switch 7, which may be threshold value switches is employed as a limit value switch for the lower limit of the reversal point of the pulsation movement. The limit values which are adjusted in the limit value indicators lie, in this connection, for the upper limit between 80% and 100% of the energizing chamber liquid level height and for the lower limit between 0% and 20% of the energizing chamber liquid height. Staggered upwardly and downwardly there follow the preliminary area, the main area and above or below, respectively, the alarm area, which is directly at the limits of the possible operating area (0%–100%).

The limit value switches 6 and 7, upon receiving a signal 4' which exceeds a limit value, produce a respective signal 6' or 7' to a respective gate of a pair of AND gates 11 and 12. The AND gates 11 and 12 also receive a signal 10', which is combined of individual signals. Of the individual signals, the signals 8' and 9' are illustrated as examples of such a combination. The signals 8' and 9' indicate that other settling machine control parts are operating. Upon occurrence of the signals 6', 7' and 10' at the AND gates 11 and 12, the proper gate provides respective signals 11' or 12' to a pair of elements 13 and 14. The elements 13 and 14 are advantageously electronic switch-through circuits, such as OR gates, which switch on respective magnetic actuating devices 15 and 16 of the inlet and outlet valves 17 and 18. The elements 13 and 14 receive respective pulses from pulse generators 19 and 20 for operating the inlet and outlet valves. Inasmuch as there is an OR function, the signals 11' and 12' alter the opening times of the inlet and outlet valves.

The signals 11' and 12' may be transferred, not only to the circuit elements 13 and 14, but also to the electronic valve controls 19 and 20. Here, they directly influence the electronic valve controls so that the inlet and outlet valves are controlled differently corresponding to the signals received from the boundary value switches.

The automatic valve control according to the present invention is indeed adapted particularly to a settling machine control having electronic structural parts, which cooperate without contact. They may, however, be incorporated with otherwise controlled settling machines. In any case, through the boundary value switches and the like and a measuring device, an influencing of the quantity of operating air may be attained, whereby only an adaptation to the particular type of the control must follow. Therefore, for example, and without further ado, an influencing of the settling machine control is possible through probes or switches built to detect the reversal points of pulsation. Likewise, the same control may utilize a limit switch or float system.

Although we have described our invention by reference to a particular illustrative embodiment thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A method of operating a wet settling machine which has a separating liquid and an excitation chamber in a settling chamber, comprising the steps of:

alternately and cyclically feeding compressed air into the excitation chamber for a predetermined air inlet time and exhausting air from the excitation chamber for a predetermined air outlet time to cause pulsation of the liquid;

sensing the changing height of the pulsating liquid in the excitation chamber; and modifying at least one of the predetermined air inlet and outlet times upon sensing heights of pulsation outside of a predetermined range by superposing on the cyclic feeding and exhausting additional open time for said at least one predetermined air inlet time and air outlet time.

2. The method of claim 1, wherein the step of modifying is further defined as:

changing the relevant predetermined time in response to pulsation heights which are outside of a range which is between 20% and 80% of the height of the excitation chamber.

3. The method of claim 1, wherein the step of alternately feeding and exhausting compressed air is further defined as:

cyclically feeding and exhausting the compressed air; and the step of modifying is further defined as:

superposing on the cyclic feeding and exhausting additional time for said at least one predetermined air inlet time and air outlet time.

4. The method of claim 1, wherein the step of cyclically feeding and exhausting is further defined as:

generating cyclically repeating signals and applying the signals alternately to air inlet and air outlet valves; and the step of modifying is further defined as:

generating an out-of-range signal and applying the out of range signal to the relevant valve.

5. The method of claim 1, wherein the step of cyclically feeding and exhausting is further defined as:

generating cyclically occurring first pulses of predetermined width and alternately with the first pulses, second pulses of predetermined width, and applying the first pulses to an air inlet valve actuator and the second pulses to an air outlet valve actuator to produce alternate valve openings and closings of specific durations; and the step of modifying is further defined as:

changing the pulse width of the relevant pulses.

6. The method of claim 5, wherein the step of modifying is further defined as:

changing the pulse width of the first pulses.

7. The method of claim 5, wherein the step of modifying is further defined as:

changing the pulse width of the second pulses.

8. The method of claim 5, wherein the step of modifying is further defined as:

changing the pulse width of the first and second pulses.

9. The method of claim 1, wherein the step of cyclically feeding and exhausting is further defined as:

generating with pulse generators, cyclically occurring first pulses of predetermined width and alternately with the first pulses, second pulses of predetermined width, and applying the first pulses to an air inlet valve actuator and the second pulses to an air outlet valve actuator to produce alternate valve openings and closings of specific durations; and the step of modifying is further defined as:

generating an out-of-range signal and applying the same to the relevant pulse generator as a control signal to change pulse width.

10. The method of claim 9, wherein the step of modifying is further defined as:

applying the out-of-range signal to change the width of the first pulses.

11. The method of claim 9, wherein the step of modifying is further defined as:

applying the out-of-range signal to change the width of the second pulses.

12. The method of claim 9, wherein the step of modifying is further defined as:

applying the out-of-range signal to change the width of the first and second pulses.

13. In a wet settling machine of the type in which air inlet and outlet valves are alternately and cyclically operated by a valve control to feed compressed air into and exhaust air from an excitation chamber to cause pulsation of a separating liquid, the improvement comprising:

first means, including a liquid level sensor in the excitation chamber, for detecting pulsation magnitudes outside of a predetermined range; and second means connected between said first means and the valve control for superposing additional valve open time for at least one of the valves in response to detection of an out-of-range condition.

14. The improved wet settling machine of claim 13, wherein said second means comprises:

an analog operating liquid level sensor producing an analog signal;

conversion means for converting the analog signal to a digital signal; and means for applying the digital signal to the valve control.

15. A control for a wet settling machine which has a separating tank with a separating liquid therein, an excitation chamber in the tank, an air inlet valve for connecting a supply of compressed air to the excitation chamber, and an air outlet valve for exhausting air from the excitation chamber, said control comprising:

pulse generator means including first and second outputs and operable to provide cyclic first pulses at said first output and, alternately with respect to said first pulses, cyclic second pulses at said second output;

switching means connected between said first and second outputs and the inlet and outlet valves and operable in response to said first pulses to cyclically operate the inlet valve and in response to said second pulses to cyclically operate the air outlet valve to cause cyclic pulsation of the separating liquid; and pulsation control means including monitoring means in the excitation chamber operable to signal the level of the separating liquid, and pulsation limiting means connected between said monitoring means and said switching means, and operable in response to levels signaled which are outside of a predetermined range to operate said switching means and cause superposed operation of at least one of the air inlet and outlet valves.

16. The control of claim 15, wherein said switching means comprises:

first and second gates connected between the air inlet and outlet valves and said first and second outputs, respectively.

17. The control of claim 16, wherein said monitoring means comprises:

an analog-operating liquid level sensor in the excitation chamber; and an amplifier means connected to said sensor and operable to provide a continuously varying level signal in accordance with the liquid pulsations.

18. The control of claim 17, wherein said pulsation limiting means comprises:

limit set point means including an input connected to said amplifier means and first and second outputs connected to said first and second gates, respectively, said limit set point means operable to provide a first additional pulse to said first gate in response to the level signal reaching a first boundary of said predetermined range and operable to provide a second additional pulse to said second gate in response to the level signal reaching a second boundary of said predetermined range, and wherein said gates are OR gates and respond to the respective pulses to cause operation of the respective valves.

19. The control of claim 18, comprising:

a pair of AND gates each including an output connected to a respective one of said OR gates, a first input connected to a respective output of said limit set point means, and a second input for receiving a signal indicating operational readiness of the settling machine.

20. The control of claim 18, wherein said pulse generator means is adjustable with respect to pulse width and comprises a pair of width-control inputs connected to respective outputs of said limit set point means.

21. A control for a wet settling machine which has a separating tank with a separating liquid therein, an excitation chamber in the tank, an air inlet valve for connecting a supply of compressed air to the excitation chamber, and an air outlet valve for exhausting air from the excitation chamber, said control comprising:

pulse generator means including first and second outputs and operable to provide cyclic first pulses at said first output and, alternately with respect to said first pulses, cyclic second pulses at said second output;

switching means including a pair of OR gates respectively connected between said first and second outputs and the inlet and outlet valves and operable in response to said first pulses to cyclically operate the inlet valve and in response to said second pulses to cyclically operate the air outlet valve to cause cyclic pulsation of the separating liquid; and pulsation control means including monitoring means in the excitation chamber operable to signal the level of the separating liquid, and pulsation limiting means connected between said monitoring means and said switching means, and operable in response to levels signaled which are outside of a predetermined range to operate said switching means and cause operation of at least one of the air inlet and outlet valves, said monitoring means comprising an analog-operating liquid level sensor in the excitation chamber, and an amplifier means connected to said sensor and operable to provide a continuously varying level signal in accordance with the liquid pulsations, said pulsation limiting means comprising limit set point means including an input connected to said amplifier means and first and second outputs connected to said first and second OR gates, respectively, said limit set point means operable to provide a first additional pulse to said first gate in response to the level signal reaching a first boundary of said predetermined range and operable to provide a second additional pulse to said second gate in response to the level signal reaching a second boundary of said predetermined range.

22. The control of claim 21, comprising:

a pair of AND gates each including an output connected to a respective one of said OR gates, a first input connected to a respective output of said limit set point means, and a second input for receiving a signal indicating operational readiness of the settling machine.

23. A control for a wet settling machine which has a separating tank with a separating liquid therein, an excitation chamber in the tank, an air inlet valve for connecting a supply of compressed air to the excitation chamber, and an air outlet valve for exhausting air from the excitation chamber, said control comprising:

pulse generator means including first and second outputs and operable to provide cyclic first pulses at said first output and, alternately with respect to said first pulses, cyclic second pulses at said second output;

said pulse generator means being adjustable with respect to pulse width and comprising first and second pulse-width control inputs, switching means connected between said first and second outputs and the inlet and outlet valves and operable in response to said first pulses to cyclically operate the inlet valve and in response to said second pulses to cyclically operate the air outlet valve to cause cyclic pulsation of the separating liquid; and pulsation control means including monitoring means in the excitation chamber operable to signal the level of the separating liquid and pulsation limiting means connected between said monitoring means and said switching means, and operable in response to levels signaled which are outside of a predetermined range to operate said switching means and cause operation of at least one of the air inlet and outlet valves, said monitoring means comprising:

an analog-operating liquid level sensor in the excitation chamber, and an amplifier means connected to said sensor and operable to provide a continuously varying level signal in accordance with the liquid pulsations, and said pulsation limiting means comprising:

limit set point means including an input connected to said amplifier means and first and second outputs connected to said first and second pulse-width control inputs, said limit set point means operable to provide a first control signal to said first pulse-width control input in response to the level signal reaching a first boundary of said predetermined range and operable to provide a second control signal to said second pulse-width control input in response to the level signal reaching a second boundary of said predetermined range to control pulse-width and the magnitude of separating liquid pulsation.

24. The control of claim 23, comprising:

a pair of AND gates each including an output connected to a respective one of said pulse-width control inputs, a first input connected to a respective output of said limit set point means, and a second input for receiving a signal indicating operational readiness of the settling machine.

* * * * *